US008654041B2

(12) United States Patent
Kang et al.

(10) Patent No.: US 8,654,041 B2
(45) Date of Patent: Feb. 18, 2014

(54) ORGANIC LIGHT EMITTING DISPLAY DEVICE HAVING MORE UNIFORM LUMINANCE AND METHOD OF DRIVING THE SAME

(75) Inventors: Chul-Kyu Kang, Suwon-si (KR); Sang-Moo Choi, Suwon-si (KR); Keum-Nam Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 279 days.

(21) Appl. No.: 12/603,556

(22) Filed: Oct. 21, 2009

(65) Prior Publication Data

US 2010/0127956 A1 May 27, 2010

(30) Foreign Application Priority Data

Nov. 26, 2008 (KR) ..... 10-2008-0118055

(51) Int. Cl.
*G09G 3/30* (2006.01)

(52) U.S. Cl.
USPC ..... 345/76; 345/82

(58) Field of Classification Search
USPC ..... 345/36, 39, 44–46, 74.1–83; 315/169.3; 313/463
See application file for complete search history.

(56) References Cited

U.S. PATENT DOCUMENTS 8,294,643 B2 * 10/2012 Chang et al. ..... 345/82
2004/0026723 A1 2/2004 Miyazawa
2005/0140605 A1 6/2005 Jung
2006/0267884 A1 * 11/2006 Takahashi et al. ..... 345/76
2007/0024544 A1 * 2/2007 Chung et al. ..... 345/76
2007/0063932 A1 * 3/2007 Nathan et al. ..... 345/76
2007/0126665 A1 6/2007 Kimura
2007/0268217 A1 11/2007 Ahn et al.
2008/0211747 A1 9/2008 Kim

FOREIGN PATENT DOCUMENTS

CA 2 557 713 A1 11/2006
CN 101075407 A 11/2007

(Continued)

OTHER PUBLICATIONS

European Search Report dated May 7, 2010, for corresponding European Patent application 09176250.0, noting listed references in this IDS.

(Continued)

*Primary Examiner* — Chanh Nguyen
*Assistant Examiner* — Ram Mistry
(74) *Attorney, Agent, or Firm* — Christie, Parker & Hale, LLP

(57) ABSTRACT

An organic light emitting display device includes a scan driver for sequentially supplying a scan signal through scan lines; a data driver for supplying an initial power through data lines during a first period of a time period when the scan signal is supplied through a corresponding scan line of the scan lines, and for supplying data signals to the data lines during a second period of the time period when the scan signal is supplied through the corresponding scan line, the second period following the first period; and pixels at crossing regions of the scan lines and the data lines.

15 Claims, 6 Drawing Sheets

(56) References Cited

FOREIGN PATENT DOCUMENTS

| | | | |
|---|---|---|---|
| CN | 101256732 | A | 9/2008 |
| CN | 101305409 | A | 11/2008 |
| EP | 2 192 571 | A2 | 6/2010 |
| JP | 2006-113586 | | 4/2006 |
| JP | 2007-140318 | | 6/2007 |
| JP | 2007-206590 | | 8/2007 |
| JP | 2008-026467 | | 2/2008 |
| JP | 2008-176287 | | 7/2008 |
| JP | 2008-241783 | | 10/2008 |
| KR | 10-2005-0025510 | | 3/2005 |
| KR | 10-2007-0112714 | A | 11/2007 |
| KR | 10-2007-0118857 | | 12/2007 |
| KR | 10-2008-0001482 | | 1/2008 |
| KR | 10-2008-0062307 | | 7/2008 |
| KR | 10-2008-0080754 | | 9/2008 |
| KR | 10-2008-0080755 | | 9/2008 |
| KR | 10-2008-0084017 | | 9/2008 |
| KR | 10-0858618 | B1 | 9/2008 |
| WO | WO 2005/036515 | A1 | 4/2005 |
| WO | WO 2008/075697 | A1 | 6/2008 |

OTHER PUBLICATIONS

KIPO Office action dated Sep. 6, 2010, for priority Korean Patent application 10-2008-0118055.

Japanese Office action dated Jul. 10, 2012, for corresponding Japanese Patent application 2009-021682, (3 pages).

Japanese Office action dated Feb. 7, 2012, for corresponding Japanese Patent application 2009-021682, 1 page.

SIPO Patent Gazette dated Dec. 12, 2012, for corresponding Chinese Patent application 200910205439.7, with English translaiton of p. 1 only, (3 pages).

KIPO Office action dated Jul. 18, 2011, for Korean Patent application 10-2009-0025841, (1 page).

U.S. Office action dated Feb. 3, 2012, for cross reference U.S. Appl. No. 12/683,189, (10 pages).

Japanese Office action dated Mar. 13, 2012, for Japanese Patent application 2009-207021, (1 page).

European Patent Gazette dated May 16, 2012, for European Patent application 10157704.7, (1 page).

SIPO Patent Gazette dated Mar. 6, 2013, for Chinese Patent application 201010125570.5, with English translation of cover page only, (3 pages).

* cited by examiner

ORGANIC LIGHT EMITTING DISPLAY DEVICE HAVING MORE UNIFORM LUMINANCE AND METHOD OF DRIVING THE SAME

CROSS-REFERENCE TO RELATED APPLICATIONS

This application claims priority to and the benefit of Korean Patent Application No. 10-2008-0118055, filed on Nov. 26, 2008, in the Korean Intellectual Property Office, the entire content of which is incorporated herein by reference.

BACKGROUND OF THE INVENTION

1. Field of the Invention

The present invention relates to an organic light emitting display device and a method of driving the same.

2. Description of Related Art

Recently, various types of flat panel display devices having reduced weight and volume in comparison to cathode ray tubes have been developed. Flat panel display devices include liquid crystal display devices, field emission display devices, plasma display panels, and organic light emitting display devices, among others.

Among these flat panel display devices, the organic light emitting display device displays images using organic light emitting diodes that emit light through the recombination of electrons and holes. The organic light emitting display device has a fast response time and is driven with low power consumption.

FIG. 1 is a circuit diagram of a conventional pixel of an organic light emitting display device. In FIG. 1, transistors included in the pixel are NMOS transistors.

Referring to FIG. 1, the conventional pixel 4 of the organic light emitting display device includes an organic light emitting diode OLED and a pixel circuit 2 connected to a data line Dm and a scan line Sn to control the organic light emitting diode OLED.

An anode electrode of the organic light emitting diode OLED is coupled to the pixel circuit 2, and a cathode electrode thereof is coupled to a second power source ELVSS. The organic light emitting diode OLED emits light having luminance corresponding to current supplied from the pixel circuit 2.

The pixel circuit 2 controls an amount of current supplied to the organic light emitting diode OLED corresponding to a data signal supplied to a data line Dm when a scan signal is supplied to a scan line Sn. To this end, the pixel circuit 2 includes a second transistor M2 (i.e., a driving transistor) coupled between a first power source ELVDD and the organic light emitting diode OLED; a first transistor M1 coupled between the second transistor M2 and the data line Dm, with a gate electrode coupled to the scan line Sn; and a storage capacitor Cst coupled between a gate electrode and a second electrode of the second transistor M2.

A gate electrode of the first transistor M1 is coupled to the scan line Sn, and a first electrode thereof is coupled to the data line Dm. A second electrode of the first transistor M1 is coupled to one terminal of the storage capacitor Cst. Here, the first electrode is either a source or a drain electrode, and the second electrode is the other electrode different from the first electrode. For example, if the first electrode is a drain electrode, the second electrode is a source electrode. When a scan signal is supplied to the first transistor M1 from the scan line Sn, the first transistor M1 is turned on, and a data signal supplied from the data line Dm is supplied to the storage capacitor Cst. At this time, a voltage corresponding to the data signal is charged into the storage capacitor Cst.

The gate electrode of the second transistor M2 is coupled to the one terminal of the storage capacitor Cst, and a first electrode thereof is coupled to the first power source ELVDD. The second electrode of the second transistor M2 is coupled to the other terminal of the storage capacitor Cst and the anode electrode of the organic light emitting diode OLED. The second transistor M2 controls an amount of current flowing from the first power source ELVDD through the organic light emitting diode OLED to the second power source ELVSS, the amount of current corresponding to the voltage stored in the storage capacitor Cst.

One terminal of the storage capacitor Cst is coupled to the gate electrode of the second transistor M2, and the other terminal thereof is coupled to the anode electrode of the organic light emitting diode OLED. A voltage corresponding to a data signal is charged into the storage capacitor Cst.

The conventional pixel 4 displays an image having a predetermined luminance by supplying current to the organic light emitting diode OLED corresponding to the voltage charged in the storage capacitor Cst. However, in such a conventional organic light emitting display device, images having uniform luminance are very difficult to display due to the threshold voltage variation of the second transistor M2.

Threshold voltages of second transistors M2 in respective pixels 4 are different from each other, and the respective pixels 4 generate light having different luminance in response to a same data signal. Therefore, images having uniform luminance cannot be displayed.

SUMMARY OF THE INVENTION

Accordingly, exemplary embodiments of the present invention provide an organic light emitting display device which may compensate for a threshold voltage of a driving transistor and a method of driving the same.

An aspect of an exemplary embodiment of the present invention provides an organic light emitting display device including: a scan driver for sequentially supplying a scan signal through scan lines; a data driver for supplying an initial power through data lines during a first period of a time period when the scan signal is supplied through a corresponding scan line of the scan lines, and for supplying data signals to the data lines during a second period of the time period when the scan signal is supplied through the corresponding scan line, the second period following the first period; and pixels at crossing regions of the scan lines and the data lines, wherein a pixel coupled to an i-th ("i" is a natural number) scan line of the scan lines and a j-th ("j" is a natural number) data line of the data lines from among the pixels includes: an organic light emitting diode having a cathode electrode coupled to a second power source; a first transistor for controlling current flowing through the organic light emitting diode; a second transistor coupled to the j-th data line and a second node, the second transistor being on when the scan signal is supplied through the i-th scan line; a third transistor coupled between a first node coupled to a gate electrode of the first transistor and the second node, the third transistor being off when the second transistor is on; a fourth transistor coupled between the first node and a reference power source, the fourth transistor being on when the scan signal is supplied through the i-th scan line; and a first capacitor coupled between the second node and an anode electrode of the organic light emitting diode.

A voltage of the data signals may be equal to or higher than a voltage of the reference power source. A voltage of the initial power may be higher than a voltage of the data signal.

The organic light emitting display device may further include a second capacitor coupled in parallel with the third transistor between the first node and the second node.

An aspect of another exemplary embodiment of the present invention provides a method of driving an organic light emitting display device, including: supplying a reference power to a gate electrode of the driving transistor when a scan signal is supplied; supplying an initial power to a second terminal of the first capacitor through a data line during a first period of a time period when the scan signal is supplied; supplying a data signal to the second terminal of the first capacitor through the data line during a second period of the time period when the scan signal is supplied, the second period following the first period, wherein a voltage at the anode electrode of the organic light emitting diode is obtained by subtracting a threshold voltage of the driving transistor from the reference power; and supplying current to the organic light emitting diode by coupling the gate electrode of the driving transistor to the second terminal of the first capacitor.

An aspect of yet another exemplary embodiment of the present invention provides a pixel of an organic light emitting display device coupled to a scan line for supplying a scan signal and a data line for supplying a data signal, including: an organic light emitting diode coupled to a second power source; a first transistor coupled between the organic light emitting diode and a first power source, the first transistor for controlling current flowing through the organic light emitting diode in accordance with the data signal; a second transistor coupled to the data line for supplying the data signal when the scan signal is supplied; a third transistor coupled between the second transistor and a gate electrode of the first transistor; a fourth transistor coupled between the gate electrode of the first transistor and a reference power source; and a first capacitor coupled between the second transistor and the organic light emitting diode; wherein the second transistor and the fourth transistor concurrently turn on and off, and wherein the third transistor is turned off when the second transistor and the fourth transistor are turned on.

In an organic light emitting display device and a method of driving the same, a desired current may be supplied to an organic light emitting diode regardless of a threshold voltage of a driving transistor. Accordingly, an image having uniform luminance may be displayed.

BRIEF DESCRIPTION OF THE DRAWINGS

The accompanying drawings illustrate exemplary embodiments of the present invention, and, together with the description, serve to explain the principles of the present invention.

DETAILED DESCRIPTION OF EXEMPLARY EMBODIMENTS

Figure 1:
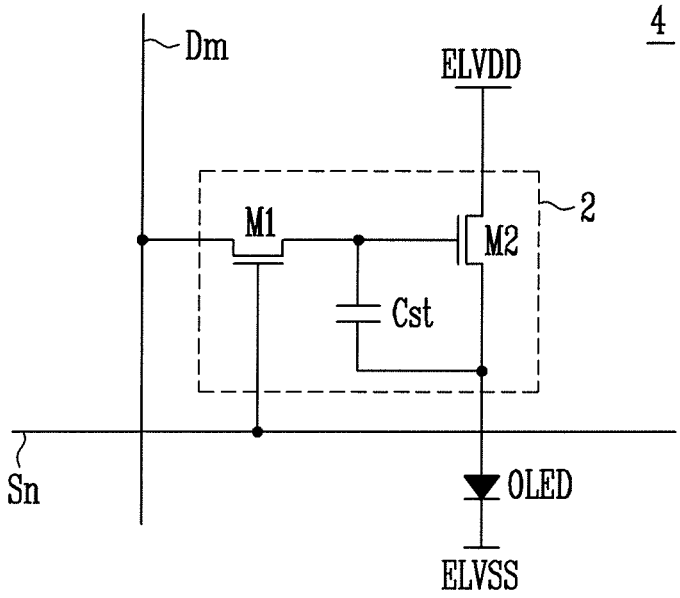
FIG. 1 (PRIOR ART)
FIG. 1 is a circuit diagram of a pixel of a conventional organic light emitting display device.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more additional elements. Further, some of the elements that are not essential to the complete understanding of the invention are omitted for clarity. Also, like reference numerals refer to like elements throughout.

Figure 2:
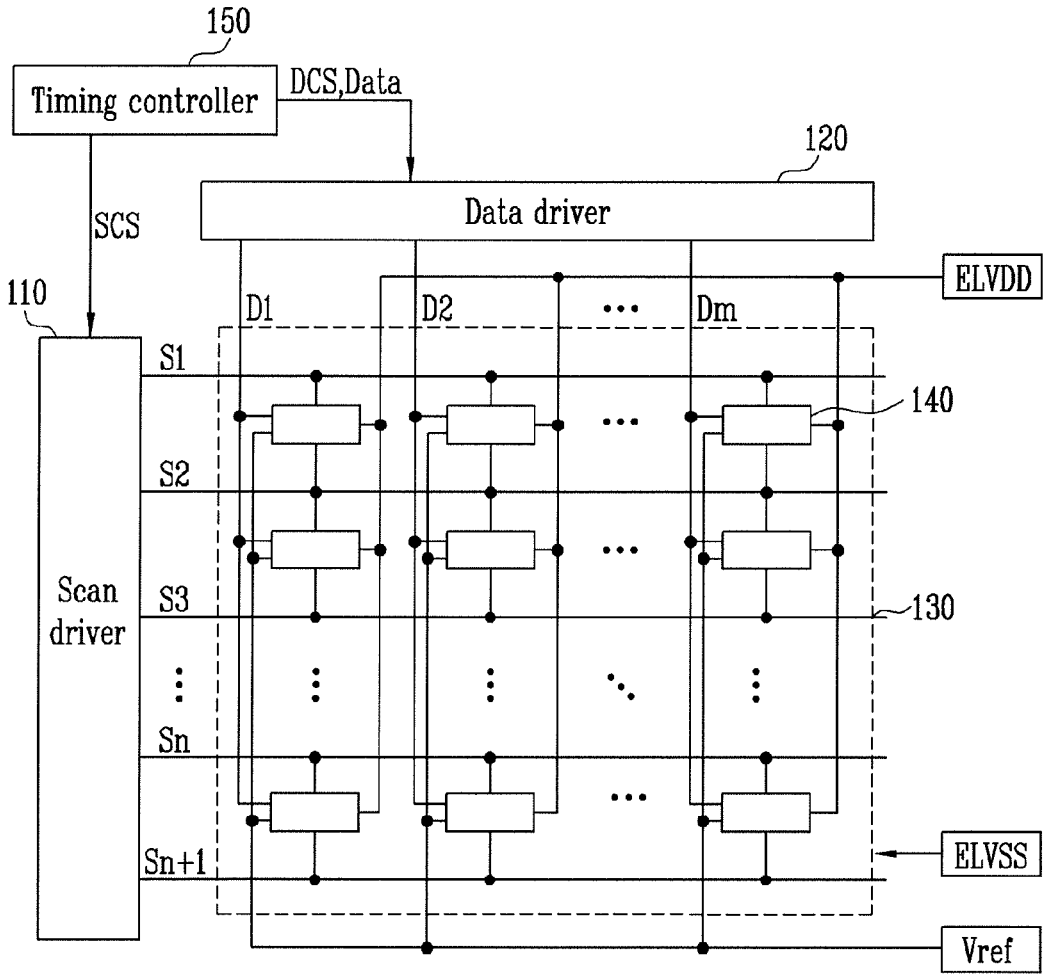
FIG. 2 is a schematic block diagram of an organic light emitting display device according to an embodiment of the present invention.

FIG. 2 is a schematic block diagram of an organic light emitting display device according to an embodiment of the present invention.

Referring to FIG. 2, the organic light emitting display device according to the embodiment of the present invention includes pixels 140 coupled to scan lines S1 to Sn+1 and data lines D1 to Dm; a scan driver 110 driving the scan lines S1 to Sn+1; a data driver 120 driving the data lines D1 to Dm; and a timing controller 150 controlling the scan and data drivers 110 and 120.

The scan driver 110 receives a scan driving control signal SCS from the timing controller 150. The scan driver 110 generates a scan signal and sequentially supplies the generated scan signal to the scan lines S1 to Sn+1.

The data driver 120 receives a data driving control signal DCS supplied from the timing controller 150. The data driver 120 supplies an initial power source to the data lines D1 to Dm during a first period of a time period when a scan signal (e.g., a high scan signal) is supplied, and supplies a data signal to the data lines D1 to Dm during a second period after the first period. Here, the voltage of the initial power source is set higher than that of the data signal.

The timing controller 150 generates a data driving control signal DCS and a scan driving control signal SCS in response to synchronization signals supplied from the outside. The data driving control signal DCS generated from the timing controller 150 is supplied to the data driver 120, and the scan driving control signal SCS generated from the timing controller 150 is supplied to the scan driver 110. The timing controller 150 also supplies data Data supplied from the outside to the data driver 120.

A display unit 130 receives a first power source ELVDD, a second power source ELVSS and a reference power source Vref supplied from the outside, and supplies them to each of the pixels 140. Each of the pixels 140 receiving the first power source ELVDD, the second power source ELVSS and the reference power source Vref generates light in response to the data signals.

Here, the voltage of the first power source ELVDD is set higher than that of the second power source ELVSS so that a current (e.g., a predetermined current) is supplied to the organic light emitting diodes. A voltage of the reference power source Vref is set equal to or lower than that of the data signal.

Meanwhile, a pixel 140 positioned in an i-th ("i" is a natural number) horizontal line is coupled to an i-th scan line and an (i+1)-th scan line, as well as a j-th ("j" is a natural number) data line. The pixel 140 includes a plurality of transistors, which may be NMOS transistors, and supplies a current which is compensated for the threshold voltage of a driving transistor to a corresponding organic light emitting diode. In other embodiments, some or all of the plurality of transistors may be PMOS transistors.

Figure 3:
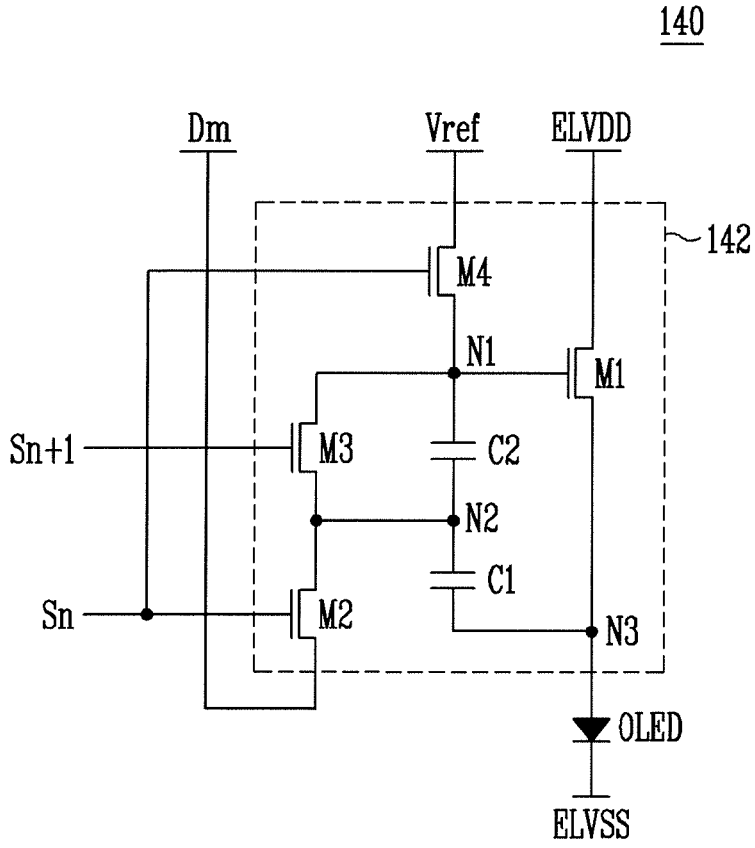
FIG. 3 is a circuit diagram of a pixel according to a first embodiment of the present invention.

FIG. 3 is a circuit diagram of a pixel according to a first embodiment of the present invention. For convenience of illustration, FIG. 3 shows a pixel positioned on an n-th horizontal line and coupled to an m-th data line Dm.

Referring to FIG. 3, the pixel 140 according to the first embodiment of the present invention includes an organic light emitting diode OLED and a pixel circuit 142 coupled to the data line Dm and the scan lines Sn and Sn+1 to control the organic light emitting diode OLED.

An anode electrode of the organic light emitting diode OLED is coupled to the pixel circuit 142, and a cathode electrode thereof is coupled to a second power source ELVSS. The organic light emitting diode OLED generates light having a luminance (e.g., a predetermined luminance) corresponding to current supplied from the pixel circuit 142.

When a scan signal is supplied through the n-th scan line Sn, the pixel circuit 142 supplies a voltage corresponding to a data signal supplied through the data line Dm and a threshold voltage of a first transistor M1 to be charged in a first capacitor C1. When a scan signal is supplied through the (n+1)-th scan line Sn+1, the pixel circuit 142 supplies current corresponding to the charged voltage to the organic light emitting diode OLED. To this end, the pixel circuit 142 includes first to fourth transistors M1 to M4, and first and second capacitors C1 and C2.

A gate electrode of the first transistor M1 is coupled to a first node N1, and a first electrode thereof is coupled to a first power source ELVDD. A second electrode of the first transistor M1 is coupled to an anode electrode of the organic light emitting diode OLED at a third node N3.

A gate electrode of the second transistor M2 is coupled to the n-th scan line Sn, and a first electrode thereof is coupled to the data line Dm. A second electrode of the second transistor M2 is coupled to a second node N2. When a scan signal is supplied through the n-th scan line Sn, the second transistor M2 is turned on to allow the data line Dm to be electrically coupled to the second node N2.

A gate electrode of the third transistor M3 is coupled to the (n+1)-th scan line Sn+1, and a first electrode thereof is coupled to the second node N2. A second electrode of the third transistor M3 is coupled to the first node N1 (i.e., the gate electrode of the first transistor M1). When a scan signal is supplied through the (n+1)-th scan line Sn+1, the third transistor M3 is turned on to allow the first node N1 to be electrically coupled to the second node N2. The third transistor M3 is in a turned-off state while the second transistor M2 is turned on.

A gate electrode of the fourth transistor M4 is coupled to the n-th scan line Sn, and a first electrode thereof is coupled to a reference power source Vref. A second electrode of the fourth transistor M4 is coupled to the first node N1. When a scan signal is supplied through the n-th scan line Sn, the fourth transistor M4 is turned on to supply the voltage of the reference power source Vref to the first node N1.

The first and second capacitors C1 and C2 are coupled in series between the first and third nodes N1 and N3. A common node of the first and second capacitors C1 and C2 is coupled to a common node (i.e., the second node N2) of the second and third transistors M2 and M3. Here, the second capacitor C2 and the third transistor M3 are coupled in parallel between the first and second node N1 and N2.

Figure 4:
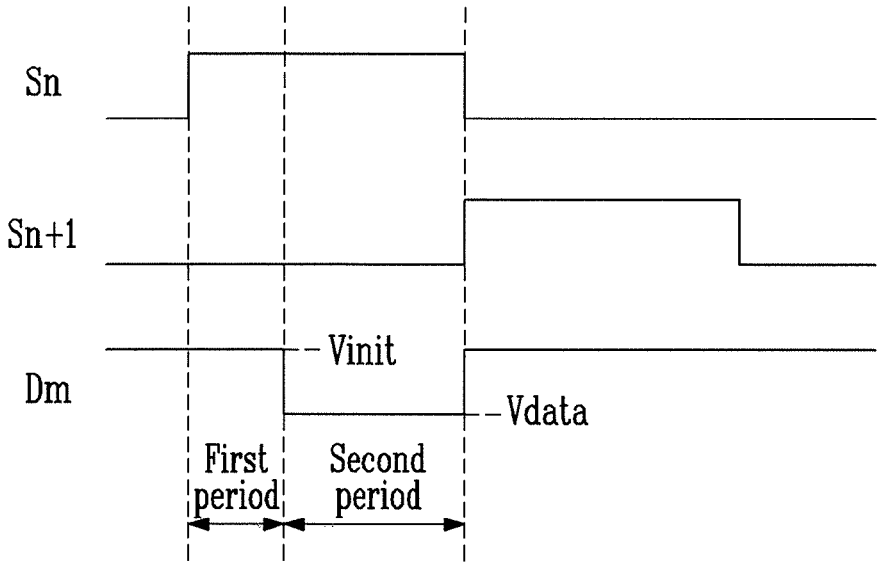
FIG. 4 is a waveform diagram illustrating a method of driving the pixel shown in FIG. 3.

FIG. 4 is a waveform diagram illustrating a method of driving the pixel shown in FIG. 3.

Operations of the pixel will be described in detail in conjunction with FIGS. 3 and 4. First, a scan signal (e.g., a high scan signal) is supplied through the n-th scan line Sn, and an initial power source Vint is supplied through the data line Dm during a first period of a time period when the scan signal is supplied through the n-th scan line Sn.

When the scan signal is supplied through the n-th scan line Sn, the second and fourth transistors M2 and M4 are turned on. When the second transistor M2 is turned on, the initial power source Vint is supplied to the second node N2. When the fourth transistor M4 is turned on, the voltage of the reference power source Vref is supplied to the first node N1. Here, the voltage of the reference power source Vref is set as a low voltage at which the first transistor M1 is turned off.

Thereafter, a data signal is supplied through the data line Dm during a second period after the first period, and accordingly the voltage at the second node N2 is dropped to the voltage of the data signal. When the voltage at the second node N2 is dropped, the voltage at the third node N3 is also dropped due to coupling of the first capacitor C1. At this time, the first transistor M1 is turned on, and the voltage at the third node N3 is raised to a voltage obtained by subtracting the threshold voltage of the first transistor M1 from the voltage of the reference power source Vref. To this end, when the data signal is supplied through the data line Dm, the voltage of the initial power source Vint is set to allow the voltage at the third node N3 to be dropped to a lower voltage than that of the reference power source Vref.

At this time, a voltage of Vdata−Vref is charged in the second capacitor C2, and a voltage of Vdata−Vref+Vth is charged in the first capacitor C1. Here, Vdata refers to a voltage of the data signal.

Thereafter, the supply of the scan signal through the n-th scan line Sn is stopped (e.g., the scan signal turns low), and the second and fourth transistors M2 and M4 are turned off. A scan signal (e.g., the high scan signal) is supplied through the (n+1)-th scan line Sn+1, and the first node N1 is electrically coupled to the second node N2. In this case, the voltage applied between the terminals of the second capacitor C2 is set as 0V, and the voltage between the gate and source electrodes of the first transistor M1 is set as a voltage charged into the first capacitor C1. That is, the voltage of the first transistor M1 is set based on Equation 1:

Equation 1

$$Vgs(M1)=V\text{data}-V\text{ref}+Vth(M1) \tag{1}$$

An amount of current flowing through the organic light emitting diode OLED is set using the voltage Vgs of the first transistor M1 based on Equation 2:

Equation 2

$$\begin{aligned} Ioled &= \beta(Vgs(M1)-Vth(M1))^2 \\ &= \beta\{(Vdata-Vref+Vth(M1))-Vth(M1)\}^2 \\ &= \beta(Vdata-Vref)^2 \end{aligned} \tag{2}$$

Referring to Equation 2, the current flowing through the organic light emitting diode OLED is determined by a voltage difference between the voltage Vdata of the data signal and the reference power source Vref. Here, since the reference power source Vref is a fixed voltage, the current flowing through the organic light emitting diode OLED is determined by the data signal.

Meanwhile, a voltage range of the first power source ELVDD, the reference power source Vref and the voltage Vdata of the data signal is set based on Equation 3:

Equation 3

$$ELVDD > Vdata \geq Vref \quad (3)$$

The voltage of the reference voltage Vref is a fixed voltage having a low voltage at which current does not flow through the organic light emitting diode OLED, and Vdata is changed corresponding to a gray level expressed as the voltage of the data signal. Here, a gray level is realized by the voltage Vdata of the data signal and the voltage of the reference power source. Therefore, the voltage Vdata of the data signal is set equal to or higher than that of the reference power source Vref.

Figure 5:
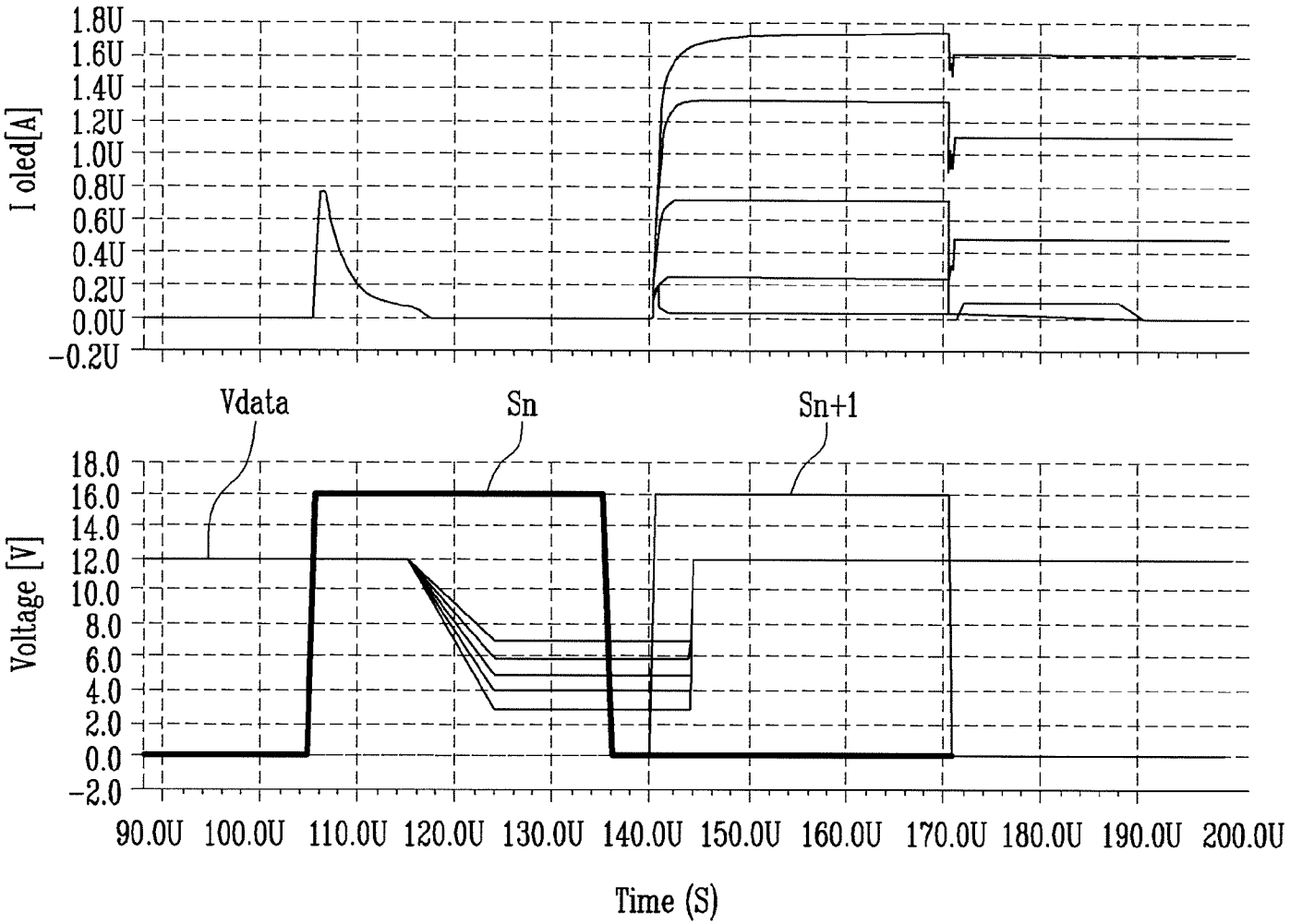
FIG. 5 is a graph showing current of an organic light emitting diode, corresponding to a change in voltage of a data signal in the pixel shown in FIG. 3.

FIG. 5 is a graph showing current flowing through an organic light emitting diode, corresponding to a voltage of a data signal.

Referring to FIG. 5, the current flowing through the organic light emitting diode OLED is changed depending on a change in voltage Vdata of the data signal. That is, in the present invention, an amount of current flowing through the organic light emitting diode OLED is changed corresponding to a change in voltage of the data signal. Accordingly, a desired gray level can be expressed.

Figure 6:
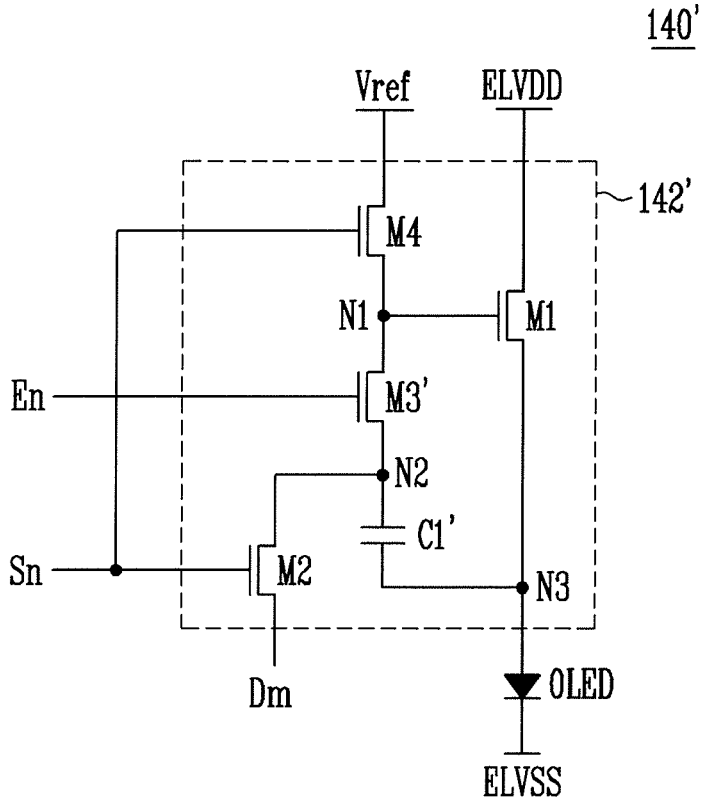
FIG. 6 is a circuit diagram of a pixel according to a second embodiment of the present invention.

FIG. 6 is a circuit diagram of a pixel according to a second embodiment of the present invention. In FIG. 6, elements identical to those of FIG. 3 are provided with the same reference numerals, and their detailed descriptions will be omitted.

Referring to FIG. 6, the pixel 140' according to the second embodiment of the present invention is coupled to a light emission control line En. Here, light emission control lines E1 to En are positioned parallel with scan lines S1 to Sn and formed in respective horizontal lines. That is, the light emission control lines E1 to En are arranged parallel with the scan lines S1 to Sn. A light emission control signal supplied through an i-th ("i" is a natural number) light emission control line Ei is supplied to overlap with a scan signal supplied through an i-th scan line Si.

Meanwhile, the scan signal sequentially supplied through the scan lines S1 to Sn may be set as a voltage (e.g., a high level voltage) at which transistors may be turned on, and the light emission control signal sequentially supplied through the light emission control lines E1 to En may be set as a voltage (e.g., a low level voltage) at which the transistors may be turned off.

A gate electrode of a third transistor M3' included in the pixel circuit 142' is coupled to the light emission control line En, and a first electrode of the third transistor M3' is coupled to a second node N2. A second electrode of the third transistor M3' is coupled to a first node N1.

A first capacitor C1' is coupled between the first electrode of the third transistor M3' (i.e., the second node N2) and a third node N3.

When comparing the pixel 140' with the pixel 140 shown in FIG. 3, the electric connection of the third transistor M3' and the first capacitor C1' is set different from that in the pixel 140. When comparing the pixel 140' with the pixel 140 shown in FIG. 3, the second capacitor C2 has been removed in the pixel 140'.

Figure 7:
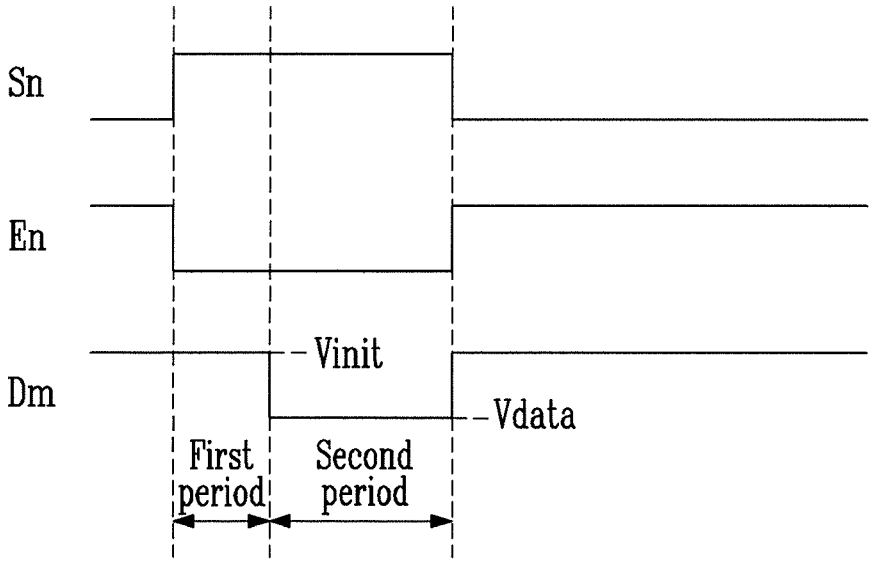
FIG. 7 is a waveform diagram illustrating a method of driving the pixel shown in FIG. 6.

FIG. 7 is a waveform diagram illustrating a method of driving the pixel shown in FIG. 6.

Operations of the pixel will be described in detail in conjunction with FIGS. 6 and 7. First, a scan signal (e.g., a high scan signal) is supplied through the n-th scan line Sn, and an initial power source Vint is supplied through a data line Dm during a first period of a time period when the scan signal is supplied through the n-th scan line Sn. A light emission control signal (e.g., a low light emission control signal) is supplied through the n-th light emission control line En during the period when the scan signal is supplied through the n-th scan line Sn.

When the light emission control signal is supplied through the n-th light emission control line En, the third transistor M3' is turned off. When the scan signal is supplied through the n-th scan line Sn, second and fourth transistors M2 and M4 are turned on. When the second transistor M2 is turned on, the initial power source Vint supplied from the data line Dm is supplied to the second node N2. When the fourth transistor M4 is turned on, the voltage of a reference voltage Vref is supplied to the first node N1.

Thereafter, a data signal is supplied through the data line Dm during a second period after the first period, and accordingly, the voltage at the second node N2 is dropped to the voltage Vdata of the data signal. When the voltage at the second node N2 is dropped, the voltage at the third node N3 is also dropped due to coupling of the first capacitor C1'. At this time, the first transistor M1 is turned on, and the voltage at the third node N3 is raised to a voltage obtained by subtracting the threshold voltage of the first transistor M1 from the voltage of the reference power source Vref. Here, a voltage set based on Equation 1 is charged into the first capacitor C1'.

Thereafter, the supply of the scan signal through the n-th scan line Sn is stopped (e.g., the scan signal is turned low), and the second and fourth transistors M2 and M4 are turned off. The supply of the light emission control signal through the n-th light emission control line En is also stopped (e.g., the light emission control signal is turned high), and the third transistor M3' is turned on. When the third transistor M3' is turned on, the second node N2 is electrically coupled to the first node N1. Accordingly, the first transistor M1 supplies current corresponding to the voltage charged into the first capacitor C1' to an organic light emitting diode OLED. A current set based on Equation 2 is therefore supplied to the organic light emitting diode OLED. That is, in the pixel 140' according to the second embodiment of the present invention, a desired current may be supplied to the organic light emitting diode OLED regardless of the threshold voltage of the first transistor M1.

Figure 8:
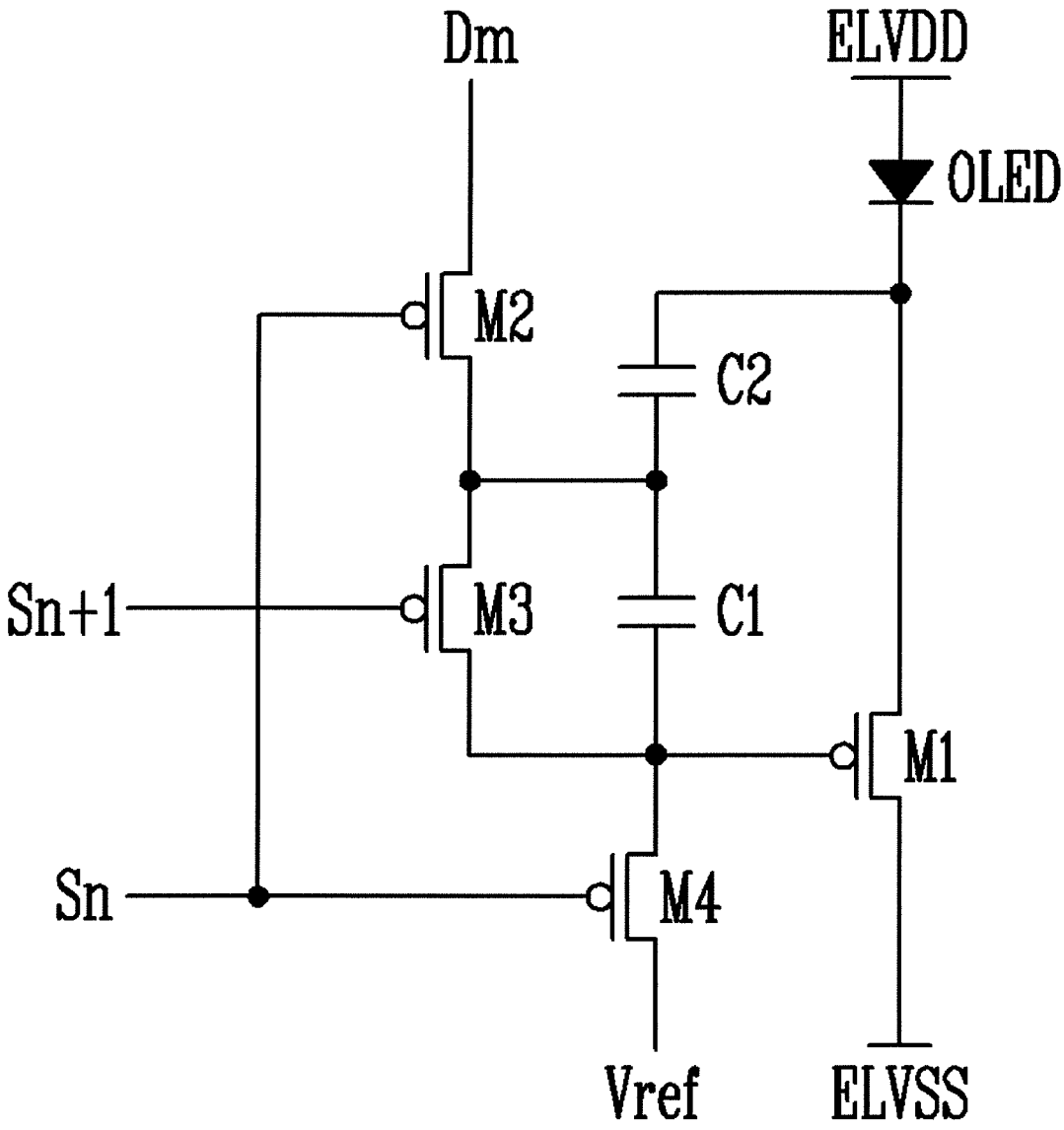
FIG. 8 is a circuit diagram showing a structure in which transistors are converted into PMOS transistors in the pixel shown in FIG. 3.

Meanwhile, it has been described in FIGS. 3 and 6 that the transistors are NMOS transistors. However, the present invention is not limited thereto. For example, the transistors of the pixel shown in FIG. 3 may instead be PMOS transistors, as shown in, for example, FIG. 8. In this case, operations are substantially similar, except that the polarities of the waveforms shown in FIG. 4 are reversed.

While the present invention has been described in connection with certain exemplary embodiments, it is to be understood that the invention is not limited to the disclosed embodiments, but is instead intended to cover various modifications and equivalent arrangements included within the spirit and scope of the appended claims, and equivalents thereof.

What is claimed is:

1. An organic light emitting display device comprising:

a scan driver for sequentially supplying a scan signal through scan lines;

a data driver for supplying an initial power through data lines during a first period of a time period when the scan signal is supplied through a corresponding scan line of the scan lines, and for supplying data signals to the data lines during a second period of the time period when the scan signal is supplied through the corresponding scan line, the second period following the first period; and pixels at crossing regions of the scan lines and the data lines, wherein a pixel coupled to an i-th ("i" is a natural number) scan line of the scan lines and a j-th ("j" is a natural number) data line of the data lines from among the pixels comprises:

an organic light emitting diode having a cathode electrode coupled to a second power source;

a first transistor for controlling current flowing through the organic light emitting diode;

a second transistor coupled to the j-th data line and a second node, the second transistor being on when the scan signal is supplied through the i-th scan line;

a third transistor coupled to the second node and coupled directly to a first node at a gate electrode of the first transistor, the third transistor being off when the second transistor is on;

a fourth transistor coupled directly between the first node and a reference power source, the fourth transistor being on when the scan signal is supplied through the i-th scan line, such that the second transistor and the fourth transistor concurrently turn on and off; and a first capacitor coupled between the second node and an anode electrode of the organic light emitting diode.

2. The organic light emitting display device of claim 1, wherein a voltage of the data signals is equal to or higher than a voltage of the reference power source.

3. The organic light emitting display device of claim 1, wherein a voltage of the initial power is higher than a voltage of the data signals.

4. The organic light emitting display device of claim 1, further comprising a second capacitor coupled in parallel with the third transistor between the first node and the second node.

5. The organic light emitting display device of claim 4, wherein, the third transistor is turned on when the scan signal is supplied through an (i+1)-th scan line of the scan lines.

6. The organic light emitting display device of claim 1, wherein the scan driver sequentially supplies a light emission control signal through light emission control lines that are parallel to the scan lines.

7. The organic light emitting display device of claim 6, wherein the light emission control signal supplied through an i-th light emission control line of the light emission control lines overlaps with the scan signal supplied through the i-th scan line, the light emission control signal being a voltage at which a corresponding one of the transistors is turned off.

8. The organic light emitting display device of claim 7, wherein a gate electrode of the third transistor is coupled to the i-th light emission control line.

9. A method of driving an organic light emitting display device provided with a driving transistor supplying current to an anode electrode of an organic light emitting diode and a first capacitor having a first terminal coupled to the anode electrode of the organic light emitting diode, the method comprising:

supplying a reference power to a gate electrode of the driving transistor when a scan signal is supplied;

supplying an initial power to a second terminal of the first capacitor through a data line during a first period of a time period when the scan signal is supplied and the reference power is supplied to the gate electrode of the driving transistor;

supplying a data signal to the second terminal of the first capacitor through the data line during a second period of the time period when the scan signal is supplied and the reference power is supplied to the gate electrode of the driving transistor, the second period following the first period, wherein a voltage at the anode electrode of the organic light emitting diode is obtained by subtracting a threshold voltage of the driving transistor from the reference power; and supplying current to the organic light emitting diode by directly coupling the gate electrode of the driving transistor to the second terminal of the first capacitor.

10. The method of claim 9, wherein a voltage of the data signal is equal to or higher than a voltage of the reference power.

11. The method of claim 9, wherein a voltage of the initial power is higher than a voltage of the data signal.

12. A pixel of an organic light emitting display device coupled to a scan line for supplying a scan signal and a data line for supplying a data signal, comprising:

an organic light emitting diode coupled to a second power source;

a first transistor coupled between the organic light emitting diode and a first power source, the first transistor for controlling current flowing through the organic light emitting diode in accordance with the data signal;

a second transistor coupled to the data line for supplying the data signal when the scan signal is supplied;

a third transistor coupled to the second transistor and coupled directly to a gate electrode of the first transistor;

a fourth transistor coupled directly between the gate electrode of the first transistor and a reference power source; and a first capacitor coupled between the second transistor and the organic light emitting diode;

wherein the second transistor and the fourth transistor concurrently turn on and off, and wherein the third transistor is turned off when the second transistor and the fourth transistor are turned on; and wherein a data driver is configured to supply an initial power through the data line in a first period of a time period when the scan signal is supplied, and to supply the data signal through the data line in a second period of the time period when the scan signal is supplied, the second period following the first period.

13. The pixel of claim 12, wherein a voltage of the initial power is higher than a voltage of the data signal.

14. The pixel of claim 12, wherein a voltage of the data signal is equal to or higher than a voltage of the reference power source.

15. The pixel of claim 12, further comprising a second capacitor coupled in parallel with the third transistor between the second transistor and the gate electrode of the first transistor.

* * * * *